US005948601A

United States Patent [19]

Rieger

[11] Patent Number: 5,948,601

[45] Date of Patent: Sep. 7, 1999

[54] PHOTOGRAPHIC ELEMENT WITH COLOR ENHANCING LAYER ADJACENT THE YELLOW DYE FORMING LAYER

[75] Inventor: John B. Rieger, Rochester, N.Y.

[73] Assignee: Eastman Kodak Company, Rochester, N.Y.

[21] Appl. No.: 08/792,496

[22] Filed: Jan. 31, 1997

[51] Int. Cl.[6] ..... G03C 7/46

[52] U.S. Cl. ..... 430/383; 430/359; 430/361; 430/504; 430/543; 430/558; 430/557; 430/551

[58] Field of Search ..... 430/504, 503, 430/543, 551, 567, 359, 361, 383, 558, 557

[56] References Cited

U.S. PATENT DOCUMENTS

| | | | |
|---|---|---|---|
| 4,040,829 | 8/1977 | Ohmatsu et al. | 430/621 |
| 4,186,011 | 1/1980 | Lohmann et al. | 430/505 |
| 5,176,972 | 1/1993 | Bloom et al. | 430/950 |
| 5,576,159 | 11/1996 | Sato et al. | 430/504 |

FOREIGN PATENT DOCUMENTS

| | | |
|---|---|---|
| 285206 | 12/1990 | Germany . |
| 53-65730 | 6/1978 | Japan . |

OTHER PUBLICATIONS

Derwent Abstract, JP 53065730.

*Primary Examiner*—Geraldine Letscher
*Attorney, Agent, or Firm*—Paul A. Leipold

[57] ABSTRACT

The invention relates to a photographic element comprising an emulsion layer comprising a cyan dye forming coupler, an emulsion layer comprising a magenta dye forming coupler, an emulsion layer comprising a yellow dye forming coupler wherein said magenta coupler comprises

MAGENTA-1 wherein $R_a$ and $R_b$ independently represent H or a substituent; X is hydrogen or a coupling-off group; and $Z_a$, $Z_b$, and $Z_c$ are independently a substituted methine group, =N—, =C—, or —NH—, provided that one of either the $Z_a$—$Z_b$ bond or the $Z_b$—$Z_c$ bond is a double bond and the other is a single bond, and when the $Z_4$—$Z_c$ bond is a carbon-carbon double bond, it may form part of an aromatic ring, and at least one of $Z_a$, $Z_b$, and $Z_c$ represents a methine group connected to the group $R_b$, and wherein between said yellow dye forming layer and said magenta dye forming layer, there is located at least one enhancer layer substantially free of silver halide comprising gelatin and said yellow dye forming coupler.

30 Claims, No Drawings

PHOTOGRAPHIC ELEMENT WITH COLOR ENHANCING LAYER ADJACENT THE YELLOW DYE FORMING LAYER

FIELD OF THE INVENTION

The invention relates a method to provide improved performance of a multilayer color photographic element. More particularly, the invention relates to providing a green light sensitive magenta layer containing a pyrazoloazole dye forming coupler, and an enhancer layer comprising a dye forming photographic coupler which is placed adjacent to a light sensitive emulsion layer that contains the same dye forming photographic coupler as in the enhancer layer.

BACKGROUND OF THE INVENTION

Current color silver halide papers utilize three color layers comprised of a red sensitive cyan layer, a green light sensitive magenta layer and blue light sensitive yellow layer. In order to increase performance of color silver halide paper in digital printers, there is a strong desire to have high gamma in all three color records. Due to the large grain size of the blue light sensitive yellow emulsion, the layer location of conventionally designed blue light sensitive yellow layers, and the high intensity reciprocity performance of conventionally sensitized blue light sensitive yellow emulsions, the gamma of the blue color record is usually considered to be a limiting factor. These effects are especially evident in areas of high dye density, that is in the shoulder and Dmax (area of maximum density) regions. For instance, in the case of the blue sensitive layer, a low shoulder would lead to black areas going blue and yellow colors desaturating. One common way to increase gamma is increase the silver coverage of the emulsion. However, increased silver causes a number of problems.

In particular, higher silver coverage leads to a reduction in the developability of the photographic element. This results in a lowering of neutral gamma for a given silver coverage at a given time of development, and an increase in the variability of gamma for a non-fully developed silver halide product.

A further effect of using high coverage of emulsion is a deleterious loss of color purity. This is caused by the tendency for the oxidized developer (Dox) to be formed in too high of a concentration to be used effectively by the color forming coupler. Thus, more of the Dox wanders from the color record in which it was formed into adjacent layers. Typically, color photographic elements contain Dox scavenging interlayers (otherwise known as anticolor-mixing layers) to prevent interlayer color contamination. In the case of large grained emulsions, the scavenging layer must be made thicker in order to react with excess Dox and prevent it from reaching another color forming layer. This also results in materials being wasted, since no dye is formed as a result of this process.

Further, there are practical limitations on how much gelatin and/or Dox scavenger can be added to a photographic element. For example, additional gelatin can not be added to some commercial color print materials without slowing down the coating operation of the element. Further, the addition of gelatin may also lead to prints sticking together after conventional processing because of dryer limitations in some processors. The addition of more Dox scavenger also has inherent difficulties. In particular, as the oil fraction of the interlayer is increased, relative to the fraction of gelatin, the layer tends to become less robust to physical abuse. One consequence is that the integrity of the layer can become comprised, and under certain stresses such as scratches occurring during processing, the photographic element will tend to break at the interlayer leaving only the bottom layer in this area.

A further problem can be the migration of the Dox scavenger (typically a hydroquinone, hydrazide or sulphonamidophenol) into the magenta imaging layer. In the case of the magenta coupler being a pyrazoloazole this leads to two concerns. The first is that many pyrazoloazoles couplers are somewhat less reactive toward oxidized developer than is the interlayer scavenger. This leads to less magenta dye formation in the regions of scavenger migration. A second impact is that some Dox scavengers (in particular, hydroquinones) destabilize the magenta dye when it is exposed to light.

In some instances, the very large grained emulsions produce a local concentration of Dox that is too high to be completely used by the appropriate coupler and/or scavenged by an anticolor mixing agent. For instance, in the case of large grained emulsions used in the blue layer, this can result in the formation of magenta colored spots in the photographic print from reaction of Dox formed in the blue layer with magenta coupler situated in the green layer.

Another approach to increasing blue gamma would be to increase the yellow coupler coverage in the blue light sensitive layer. This approach does not yield substantial gains in gamma due to the excess of coupler already coated in the layer. Also, substantial increases in coupler will increase levels of non-matrixed organics, which will damage the structural integrity of the gelatin matrix.

U.S. Pat. No. 4,040,829 describes a structure where a semi-diffusable coupler layer is coated on top of the topmost emulsion layer. However, in this invention the intent is to use the same or another non-diffusable image coupler in the adjacent enhancer layer. In a preferred embodiment, the non-diffusable coupler would be the same in both layers and would be used in the bottom-most layers of the element.

European Patent Application No. 0 062 202 describes a structure in which the emulsion layers are sandwiched between two coupler containing layers. The structure of the current invention differs in that it requires coating a coupler containing layer above a coupler and silver containing layer.

Japanese Kokai Patent Application No. Sho 53[1978]-65730 teaches using an additional 0.01–0.3 g/m$^2$ of yellow coupler in the interlayer between the blue light sensitive layer and the green light sensitive layer. The inventive structure differs because the additional coupler is contained in an enhancer layer which is sandwiched between a coupler and silver containing layer on one side and an anticolor mixing layer on the other side. In addition, in the inventive structure, no additional amount of coupler is used in the enhancer layer. Thus, in a preferred embodiment, some of the coupler normally used in the photosensitive layer is shifted into the enhancer layer and this avoids the additional cost of using more coupler in the element.

U.S. Pat. No. 5,576,159—Sato et al describes the use of a split layer format with an enhancer layer. However, it does not describe how to solve problems associated with the use of high silver in combination with pyrazoloazole magenta couplers.

PROBLEM TO BE SOLVED BY THE INVENTION

There is a need to provide improved reproduction of fine detail areas of a color photographic print. It particularly relates to the improvement of print areas in a color photograph by preventing fringing which is the bleeding of color into solid color areas which results in blurring of fine detail. There is also a need for improved color saturation and brighter colors in digitally exposed color photographic prints.

SUMMARY OF THE INVENTION

It is an object of the invention to overcome disadvantages of digitally exposed color papers.

Another object is to provide a color paper that has improved color saturation and fine print detail when digitally exposed.

A further object is to provide a color paper that has more accurate color reproduction when digitally exposed.

These and other objects of the invention are generally accomplished by providing a photographic element comprising an emulsion layer comprising a cyan dye forming coupler, an emulsion layer comprising a magenta dye forming coupler, an emulsion layer comprising a yellow dye forming coupler wherein said magenta coupler comprises

MAGENTA-1

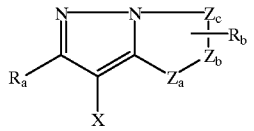

wherein $R_a$ and $R_b$ independently represent H or a substituent; X is hydrogen or a coupling-off group; and $Z_a$, $Z_b$, and $Z_c$ are independently a substituted methine group, =N—, =C—, or —NH—, provided that one of either the $Z_a$—$Z_b$ bond or the $Z_b$—$Z_c$ bond is a double bond and the other is a single bond, and when the $Z_b$—$Z_c$, bond is a carbon-carbon double bond, it may form part of an aromatic ring, and at least one of $Z_a$, $Z_b$, and $Z_c$ represents a methine group connected to the group $R_b$, and wherein between said yellow dye forming layer and said magenta dye forming layer, there is located at least one enhancer layer substantially free of silver halide comprising gelatin and said yellow dye forming coupler.

In another embodiment the invention comprises a method of forming a photographic image comprising providing a photographic element comprising a photographic element comprising an emulsion layer comprising a cyan dye forming coupler, an emulsion layer comprising a magenta dye forming coupler, an emulsion layer comprising a yellow dye forming coupler wherein said magenta coupler comprises

MAGENTA-1

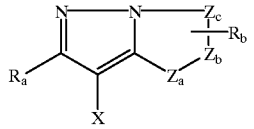

wherein $R_a$ and $R_b$ independently represent H or a substituent; X is hydrogen or a coupling-off group; and $Z_a$, $Z_b$, and $Z_c$ are independently a substituted methine group, =N—, =C—, or —NH—, provided that one of either the $Z_a$—$Z_b$ bond or the $Z_b$—$Z_c$ bond is a double bond and the other is a single bond, and when the $Z_b$—$Z_c$ bond is a carbon-carbon double bond, it may form part of an aromatic ring, and at least one of $Z_a$, $Z_b$, and $Z_c$ represents a methine group connected to the group $R_b$, and wherein between said yellow dye forming layer and said magenta dye forming layer, there is located at least one enhancer layer substantially free of silver halide comprising gelatin and said yellow dye forming coupler, exposing said element in an exposure time of less than 1 millisecond, and developing said element to obtain a photographic image.

ADVANTAGEOUS EFFECT OF THE INVENTION

The invention provides a photographic element having improved color reproduction when digitally exposed. The invention photographic element provides improved fine details as there is substantially no blurring of fine details between adjacent areas of light and dark in the developed photographs.

DETAILED DESCRIPTION OF THE INVENTION

The invention provides many advantages over prior silver halide color print materials for digital imaging. The invention provides photographic papers that have improved color reproduction providing brighter colors. Further the colors produced are more accurately rendered and true to the colors of the exposed image. The color papers of the invention also provide improved rendering of fine details without blurring of the edges between dark and light areas. The color paper of the invention also provides improved image stability. These and other advantages of the invention will be clearer from the description below.

The use of pyrazoloazole magenta dye forming couplers allows silver coverage reduction in the green light sensitive magenta layer without any reduction in magenta gamma. This reduction in magenta silver coverage allows an increase in silver coverage in the blue light sensitive yellow layer without increasing total silver coverage, which increases yellow gamma and improves performance in a digital exposing device. In this way, total silver coverage is kept constant, while providing an advantage in yellow gamma. It is important to keep total silver coverage low, in order to keep cost low and maintain acceptable developability and bleachability. Total silver coverage of all imaging records is typically kept below 1.0 $g/m^2$.

The increase in silver coverage in the blue light sensitive yellow layer creates a number of problems as discussed previously, which are solved by the use of the split layer format with an enhancer layer.

Use of a split layer format with an enhancer layer, in which part of the color forming coupler in the original photosensitive layer is coated in a separate layer that is sandwiched between the photosensitive layer containing coupler and an anticolor mixing layer overcomes the problems found in the prior art and surprisingly also provides improved efficiency with regard to the levels of materials used in the element.

Thus, it is an object of this invention to provide a color reflective silver halide paper which has improved gamma when exposed in digital printers. It is a further object to provide a photographic element with has higher reflective densities, especially in the shoulder and Dmax regions. In addition, it is an object of this invention to provide a photographic element in which there is a reduced propensity for color contamination. Other objects of this invention will be apparent in this disclosure.

It has been found that improved photographic performance can be achieved by use of a green light sensitive magenta layer containing a pyrazoloazole dye forming coupler, and an enhancer layer which is coated between a conventional color forming layer that contains both a yellow dye forming coupler dispersion and a blue light sensitive silver halide emulsion and an anticolor-mixing layer which contains an anticolor-mixing (antistain or Dox scavenging) agent.

In a preferred embodiment of the invention, the enhancer layer contains a yellow coupler and it is situated between a conventional blue sensitive layer (coated closest to the support) and a Dox scavenging interlayer. This enhancing layer consists of gel and coupler and does not contain a significant amount of silver halide.

Generally in practicing the invention the amount of coupler used in the photographic element is about the same as in the prior art. The amount of coupler used in the conventional light sensitive layer is reduced by the amount of coupler added to the enhancer layer.

In another preferred embodiment, greater than 50% of the total coupler in the split imaging record is used in the conventional light sensitive layer, with the remainder used in the enhancer layer.

In a most preferred embodiment, the image coupler used in the green light sensitive magenta layer is M-2.

The color enhancer layer may comprise any suitable proportion of the yellow coupler in the photographic element. Suitably, the proportion of the total yellow coupler in the photographic element that is present in the color enhancer layer is less than 50%. The yellow coupler in the color enhancer layer generally comprises greater than 15% of the total yellow coupler in the element. It is preferred that the yellow coupler in the color enhancer layer comprises between about 30 and 40% of the total yellow coupler in said element.

The magenta coupler utilized in the invention may be any magenta coupler of the following structure:

MAGENTA-1

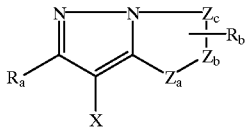

wherein $R_a$ and $R_b$ independently represent H or a substituent; X is hydrogen or a coupling-off group; and $Z_a$, $Z_b$, and $Z_c$ are independently a substituted methine group, =N—, =C—, or —NH—, provided that one of either the $Z_a$—$Z_b$ bond or the $Z_b$—$Z_c$ bond is a double bond and the other is a single bond, and when the $Z_b$—$Z_c$ bond is a carbon-carbon double bond, it may form part of an aromatic ring, and at least one of $Z_a$, $Z_b$, and $Z_c$ represents a methine group connected to the group $R_b$.

Preferred magenta couplers are 1H-pyrazolo[5,1-c]-1,2,4-triazole and 1H-pyrazolo[1,5-b]-1,2,4-triazole. Examples of 1H-pyrazolo[5,1-c]-1,2,4-triazole couplers are described in U.K. Patent Nos. 1,247,493; 1,252,418; 1,398,979; U.S. Pat. Nos. 4,443,536; 4,514,490; 4,540,654; 4,590,153; 4,665,015; 4,822,730; 4,945,034; 5,017,465; and 5,023,170. Examples of 1H-pyrazolo[1,5-b]-1,2,4-triazoles can be found in European Patent applications 176,804; 177,765; U.S. Pat. Nos. 4,659,652; 5,066,575; and 5,250,400.

In particular, pyrazoloazole magenta couplers of general structures P-1 and P-2 are especially preferred:

P-1

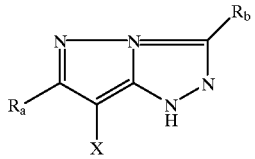

P-2

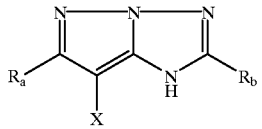

wherein $R_a$, $R_b$, and X are as defined for MAGENTA-1.

Particularly preferred are the two-equivalent versions of magenta couplers P-1 and P-2 wherein X is not equal to a hydrogen. This is the case because of the advantageous drop in silver required to reach the desired density in the print element.

Typical magenta couplers that may be used in the inventive photographic element are shown below.

M-1

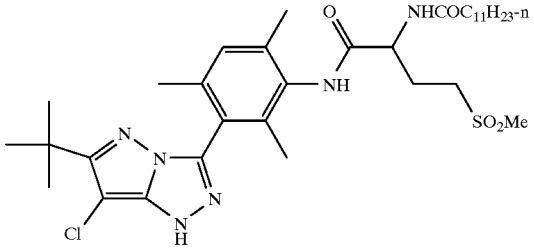

M-2

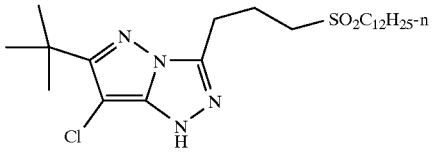

-continued
M-3
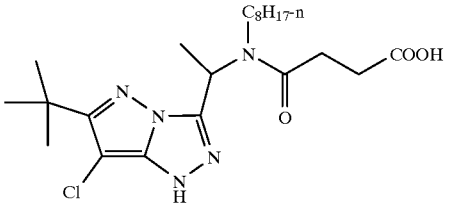
M-4
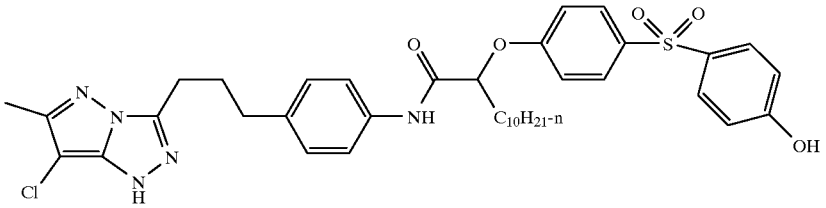
M-5
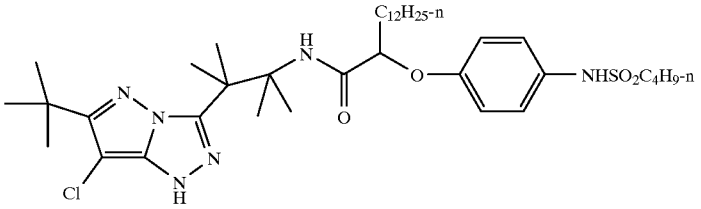
M-6
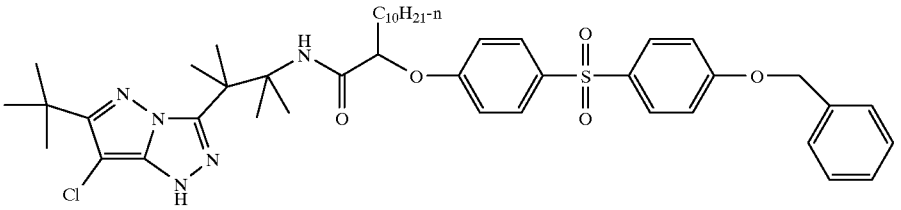
M-7
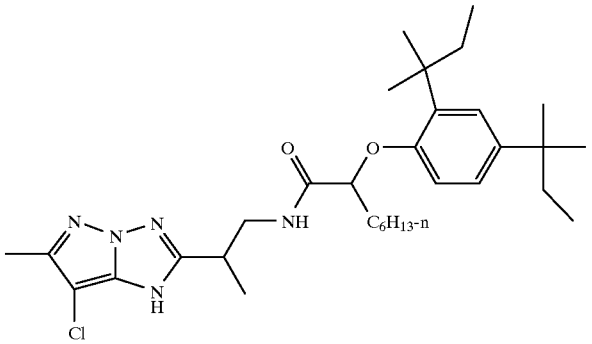
M-8
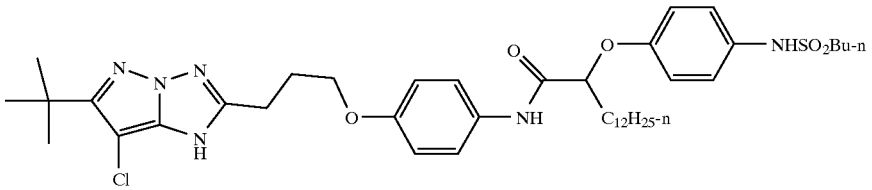

-continued

M-9

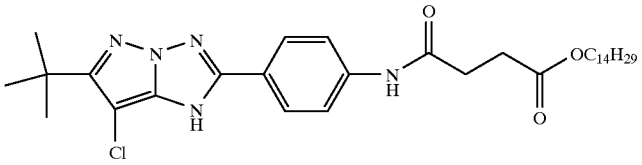

The most preferred magenta coupler is

M-2

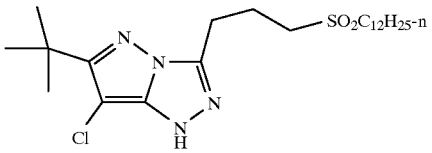

Couplers that form yellow dyes upon reaction with oxidized color developing agent and which are useful in elements of the invention are described in such representative patents and publications as: U.S. Pat. Nos. 2,875,057; 2,407,210; 3,265,506; 2,298,443; 3,048,194; 3,447,928 and "Farbkuppler—Eine Literature Ubersicht," published in Agfa Mitteilungen, Band III, pp. 112–126 (1961). Such couplers are typically open chain ketomethylene compounds. Also preferred are yellow couplers such as described in, for example, European Patent Application Nos. 482,552; 510,535; 524,540; 543,367; and U.S. Pat. No. 5,238,803.

Typical preferred yellow couplers are represented by the following formulas:

YELLOW-1

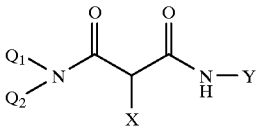

YELLOW-2

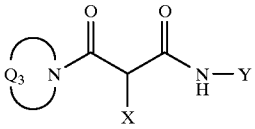

YELLOW-3

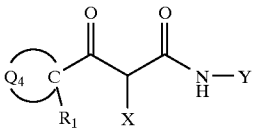

-continued

YELLOW-4

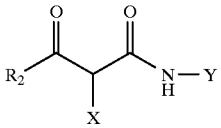

YELLOW-5

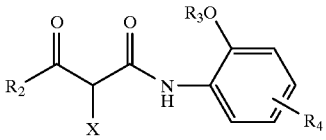

wherein $R_1$, $R_2$, $R_3$, $R_4$, $Q_1$ and $Q_2$ each represent a substituent; X is hydrogen or a coupling-off group; Y represents an aryl group or a heterocyclic group; $Q_3$ represents an organic residue required to form a nitrogen-containing heterocyclic group together with the >N—; and $Q_4$ represents nonmetallic atoms necessary to from a 3- to 5-membered hydrocarbon ring or a 3- to 5-membered heterocyclic ring which contains at least one hetero atom selected from N, O, S, and P in the ring. Particularly preferred is when $Q_1$ and $Q_2$ each represent an alkyl group, an aryl group, or a heterocyclic group, and $R_2$ represents an aryl or tertiary alkyl group. Preferred yellow couplers for use in elements of the invention are represented by YELLOW-4, wherein $R_2$ represents a tertiary alkyl group, Y represents an aryl group, and X represents an aryloxy or N-heterocyclic coupling-off group. Even more preferred yellow couplers are represented by YELLOW-5, wherein $R_2$ represents a tertiary alkyl group, $R_4$ represents a substituent and X represents an aryloxy or N-heterocyclic coupling-off group.

Typical yellow couplers that may be used in the inventive photographic element are shown below.

Y-1
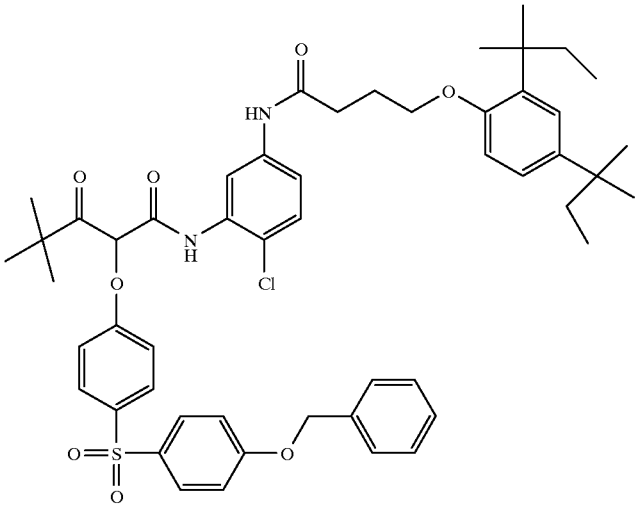
Y-2
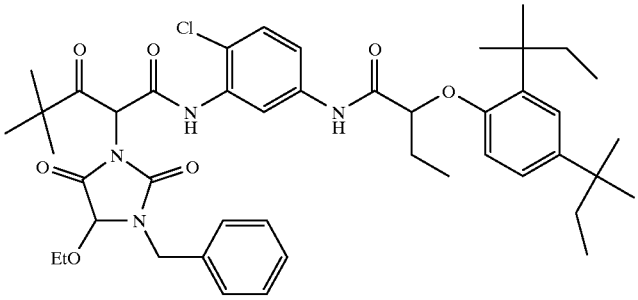
Y-3
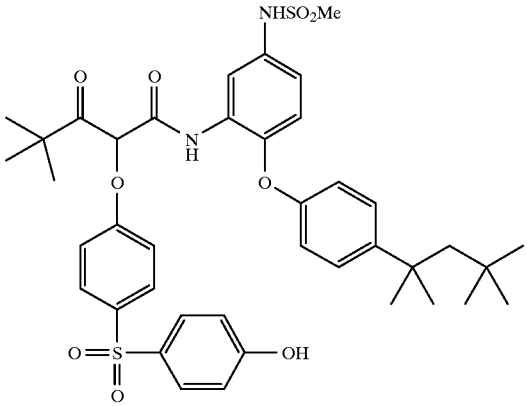
Y-4
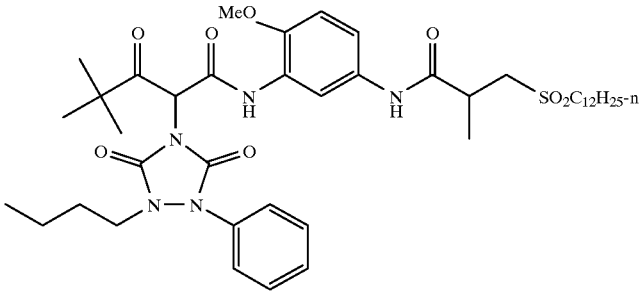

-continued
Y-5
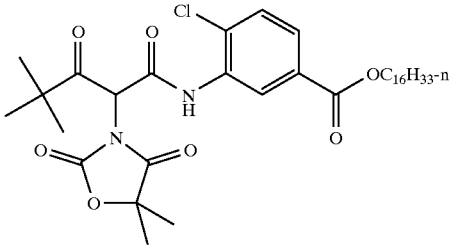
Y-6
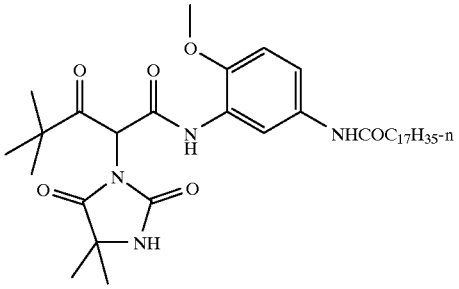
Y-7
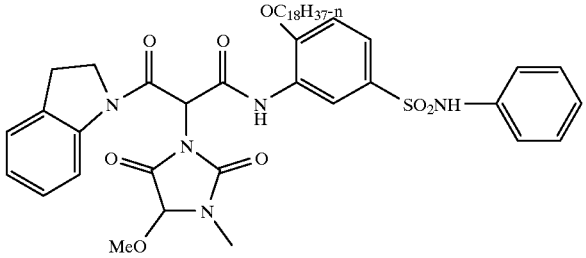
Y-8
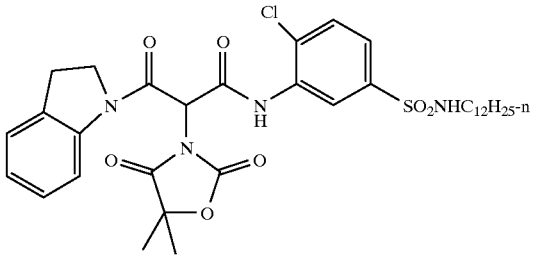
Y-9
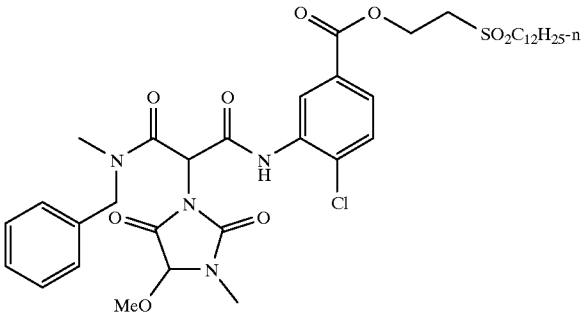

-continued

Y-10

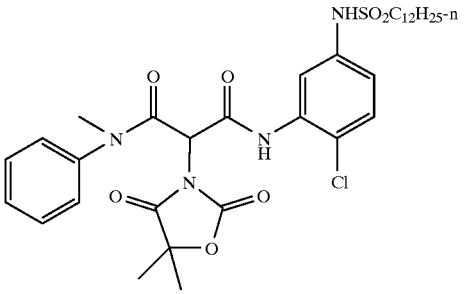

Y-11

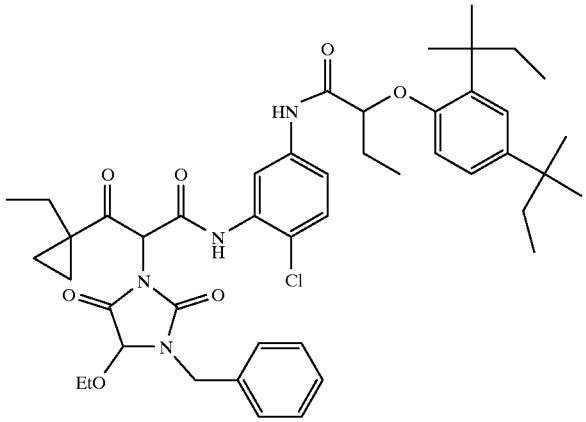

The amount of silver in the yellow layer is controlled to provide high density of yellow dye in the saturated areas of blue light exposure. The molar ratio of blue sensitized silver to total yellow coupler in said element is preferably between about 3.0 and 6.0 to provide highly saturated areas of yellow dye in the areas exposed to the greatest amount of blue light and reducing blurring between areas of light and dark.

The silver content of the layer containing blue sensitized silver halide emulsion and yellow dye forming coupler comprises any amount of silver that provides the desired performance of the yellow coupler present. The preferred amount of silver is between about 0.3 and 0.5 g/m$^2$ to provide improved saturation of yellow dye in the high exposure areas and reduced blurring between areas of light and dark.

The yellow dye forming coupler layer generally is the layer in the photographic element that is furthest from the source of illumination for exposure. Generally the middle layer of the three photosensitive layers is the layer containing the magenta dye forming coupler. In the element of the invention there are at least two layers between the emulsion layer containing the magenta dye forming coupler and the emulsion layer containing yellow dye forming coupler. These layers are the color enhancing layer containing yellow coupler but free of emulsion, and a layer comprising gelatin and an oxidized developer scavenger.

The magenta couplers preferred for the invention are efficient in the use of silver to generate magenta dye. As a result of this efficiency it is possible to use a greater amount of silver in the yellow dye forming layer without significantly increasing the cost of the photographic element by increasing the total amount of silver or reducing the developability and bleachability of the exposed image. By improved bleachability it is meant that photographic element may be processed with efficient removal of silver during bleaching in a short process time. By improved developability it is meant that the photographic element exhibits good development of exposed silver in a short development time.

The total silver amount utilized in the photographic elements of the invention may be any amount that provides a pleasing photographic quality and efficient developability. Generally the amount of total silver in the elements of the invention is greater than 0.7 g/m$^2$. A typical amount is between 0.8 and 1 g/m$^2$ to result in saturated colors and rapid processability.

The gelatin layer free of coupler and silver halide located between the emulsion layer containing yellow dye forming coupler and the layer containing magenta dye forming coupler comprises an oxidized developer scavenger. Suitable scavengers are hydroquinones, hydrazides, and sulfonamidophenols. The oxidized developer scavenger is preferably 2,5-di-tert-octyl hydroquinone, as it efficiently scavenges oxidized developer, is low in cost, and does not adversely affect photographic qualities.

The ratio of gelatin to other organic materials in the photographic element is controlled to provide good physical integrity. A preferred ratio of gelatin to other organic materials is between about 1.5 and 6.0. A most preferred ratio of gelatin to other organic materials is between about 2.5 and 5.0.

The emulsion layer containing yellow dye forming coupler comprises gelatin in sufficient amount to provide good resistance to fogging of the yellow emulsion by scratching. Suitably the emulsion layer containing yellow dye forming coupler comprises gelatin in amount of at least 1.10 g/m$^2$.

The emulsions utilized in the photographic element of the invention may be any emulsion suitable for a color print material. In particular, it would advantageous to use the invention in combination with emulsions with high sensitivity such as high chloride [100] tabular grain emulsions, as is described in U.S. Pat. Nos. 5,314,798, 5,320,938, and 5,356,764; and high chloride [111] tabular grain emulsions, as is described in U.S. Pat. Nos. 5,264,337 and 5,292,632. Further, ruthenium doped emulsions would also be particularly advantageous (see U.S. Pat. Nos. 4,945,035, 5,252,451, 5,256,530, 5,385,817, and U.S. patent application Ser. No. 93/003,181 by MacIntyre and Bell filed Jan. 12, 1993). In addition, addenda can be added to the emulsion to increase the effective dye-speed such as described in U.S. patent application Ser. No. 94/331,786 by Johansson and Lok filed Oct. 31, 1994. Particularly advantageous would be the use of silver chloride emulsions which have up to 1.0% iodide such as described in U.S. patent application Ser. No. 94/362,283 by Chen et al entitled "Cubical Silver Iodochloride Emulsions, Processes For Their Preparation And Photographic Print Elements" filed Dec. 22, 1994.

The precipitation of silver chloride emulsions has historically shown less morphological variety than that of silver bromide. The faces of silver bromide crystals lying in the <100> and <111> orientation are inherently stable, hence silver bromide forms cubes, octahedra, and the variety of twinned morphologies depending primarily on the excess halide concentrations during precipitation. In contrast, silver chloride precipitations form cubes over much of the range of excess halide conditions due to the instability of the silver chloride <111> face. However, great advances have been made in this field over the past few years. A variety of methods are known now for producing silver chloride tabular grain emulsions of the traditional type with parallel twin planes and <111> major faces, as taught in U.S. Patents: U.S. Pat. No. 4,399,215 (1983), U.S. Pat. No. 4,400,463 (1983), U.S. Pat. No. 4,713,323 (1987), U.S. Pat. No. 4,804,621 (1989), U.S. Pat. No. 4,783,398 (1988), U.S. Pat. No. 4,952,491 (1990), U.S. Pat. No. 4,983,508). These methods employ strongly adsorbed growth modifiers to stabilize the <111> face: such modifiers often restrict the spectral and chemical sensitization process or induce fog. Twinned morphologies with <100> major faces do not have high surface-to-volume ratios and suffer from the deficiencies of low-aspect ratio emulsions. Inducing anisotropic growth without major growth-enhancing defects like twin planes has been difficult. Individual grains of low-aspect ratio tabular silver chloride with <100> major faces have also been observed in various ripening and growth modifier studies, for example: *J. Photogr. Sci.,* 36: 182–188 (1988); *J. Imaging Sci.,* 30: 198–209 (1986); Symposium: Torino 1963, *Photographic Science*, Focal Press, pp. 52–55.

The major breakthrough was disclosed in 1994 in U.S. Pat. No. 5,320,938 where the novel method of precipitation produced the new type of inherently stable high-aspect ratio tabular silver chloride emulsions prepared by using small amounts of iodide early in the precipitation to induce anisotropic growth. These grains are square to rectangular in shape with aspect ratios up to 20 or more. Electron diffraction shows that the major face lies in the <100> crystallographic orientation, and as would be expected, TEM analysis of cryosectioned grains shows no twin plane. The art of precipitation of these grains was developed even further, as disclosed, for example, in U.S. Pat. No. 5,413,904; U.S. Pat. No. 5,449,596; European patent Application 670,515 A2.

A typical precipitation consists of a double jet nucleation at 35° C. and at pCl of 1.9 to 2.3 followed by controlled addition of a dilute solution containing an iodide ion to promote anisotropic growth of the formed AgCl seeds. This step is followed by a short hold to allow ripening, then a double jet growth with sodium chloride and silver nitrate is employed to maintain a constant excess halide level. The final iodide content of these emulsions is typically 0.1 mole percent or less. A low methionine gelatin is preferentially used. In order to enhance photographic performance of these emulsions, dopants can be used, as described in *Research Disclosure*, Item 36544, Section I-D. *Research Disclosure* is published by Kenneth Mason Publications, Ltd., Dudley House, 12 North Street, Emsworth, Hampshire P010 7DQ, England. In particular cesium pentachloronitrosylosmate is useful to control contrast, potassium hexacyanoruthenate can enhance speed and potassium hexachloroiridate can significantly modify reciprocity behavior of the emulsions of the present invention. Emulsion addenda that absorb to grain surfaces, such as antifoggants, stabilizers and dyes, can also be added to these emulsions during precipitation, as described in *Research Disclosure*, Item 36544, cited above, Section I-D. As an example, a water soluble disulfides, as disclosed in U.S. Pat. 5,418,127, can be used to control fogging during emulsion precipitation. These emulsions can be prepared within wide range of aspect ratios (2–20) and ECD sizes (0.5–5 micron). ECD size is an Equivalent Circular Diameter, as measured by any convenient technique.

After precipitation and before chemical sensitization the emulsion can be washed by any convenient technique. Conventional washing techniques are disclosed by *Research Disclosure*, Item 36544, cited above, Section III.

Further, these emulsions can be chemically and spectrally sensitized in any convenient manner as disclosed in *Research Disclosure*, Item 36544, cited above, Sections IV and V.

The photographic elements of the invention are particularly suitable for digital exposure. Methods of digital exposure such as laser scanning, light emitting diodes, cathode ray tubes, liquid crystal display, digital mirrors or light valves may be utilized. The photographic elements of the invention are suitable for exposures of less than 1 millisecond. They further are suitable for exposure of less than $1\times10^{-5}$ seconds such as is performed with a laser scanner printing device. The elements of the invention are particularly suitable for exposure between $1\times10^{-5}$ and $1\times10^{-7}$ seconds.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like.

In the following discussion of suitable materials for use in the emulsions and elements that can be used in conjunction with this invention, reference will be made to *Research Disclosure*, September 1994, Item 36544, published by Kenneth Mason Publications, Ltd., Dudley House, 12 North Street, Emsworth, Hampshire P010 7DQ, England, which will be identified hereafter by the term *"Research Disclosure."* The Sections hereafter referred to are Sections of the *Research Disclosure*, Item 36544.

The silver halide emulsions employed in these photographic elements can be either negative-working or positive-working. Suitable emulsions and their preparation as well as methods of chemical and spectral sensitization are described in Sections I, and III–IV. Vehicles and vehicle related addenda are described in Section II. Dye image formers and modifiers are described in Section X. Various additives such as UV dyes, brighteners, luminescent dyes, antifoggants, stabilizers, light absorbing and scattering materials, coating aids, plasticizers, lubricants, antistats and matting agents are described, for example, in Sections VI–IX. Layers and layer arrangements, color negative and color positive features, scan facilitating features, supports, exposure and processing can be found in Sections XI–XX.

Further, it would be advantageous to practice elements of the invention in conjunction with the materials disclosed in an article entitled "Typical and Preferred Color Paper, Color Negative, and Color Reversal Photographic Elements and Processing" which was published in *Research Disclosure*, February 1995, Volume 370. In particular, Sections I–XIII, XV–XVIII, and XXIIIA are especially relevant.

Any photographic coupler known to the art can be used in conjunction with elements of the invention. Suitable couplers are described in *Research Disclosure*, Item 36544, Section X. In addition, the structures of particularly preferred couplers can be found in an article entitled "Typical and Preferred Color Paper, Color Negative, and Color Reversal Photographic Elements and Processing" which was published in *Research Disclosure*, February 1995, Volume 370, Section II.

To control the migration of various components, it may be desirable to include a high molecular weight hydrophobe or "ballast" group in the component molecule. Representative ballast groups include substituted or unsubstituted alkyl or aryl groups containing 8 to 40 carbon atoms. Representative substituents on such groups include alkyl, aryl, alkoxy, aryloxy, alkylthio, hydroxy, halogen, alkoxycarbonyl, aryloxcarbonyl, carboxy, acyl, acyloxy, amino, anilino, carbonamido (also known as acylamino), carbamoyl, alkylsulfonyl, arysulfonyl, sulfonamido, and sulfamoyl groups wherein the substituents typically contain 1 to 40 carbon atoms. Such substituents can also be further substituted. Alternatively, the molecule can be made immobile by attachment to polymeric backbone.

It is understood throughout this disclosure that any reference to a substituent by the identification of a group containing a substitutable hydrogen (e.g. alkyl, amine, aryl, alkoxy, heterocyclic, etc.), unless otherwise specifically stated, shall encompass not only the substituent's unsubstituted form, but also its form substituted with any photographically useful substituents. Usually the substituent will have less than 30 carbon atoms and typically less than 20 carbon atoms. Typical examples of substituents include alkyl, aryl, anilino, carbonamido, sulfonamido, alkylthio, arylthio, alkenyl, cycloalkyl, and further to these exemplified are halogen, cycloalkenyl, alkinyl, heterocyclyl, sulfonyl, sulfinyl, phosphonyl, acyl, carbamoyl, sulfamoyl, cyano, alkoxy, aryloxy, heterocyclyloxy, siloxy, acyloxy, carbamoyloxy, amino, alkylamino, imido, ureido, sulfamoylamino, alkoxycarbonylamino, aryloxycarbonylamino, alkoxycarbonyl, aryloxycarbonyl, heterocyclylthio, spiro compound residues and bridged hydrocarbon compound residues.

In this invention, the presence of an interlayer containing an anticolor-mixing agent (antistain or Dox scavenger) is necessary. Typically, these scavengers are ballasted to keep them in the layer in which they were coated. The scavengers work by reducing any excess oxidized developer back to the developer form. Anticolor-mixing agents include compounds such as derivatives of hydroquinones (e.g. see U.S. Pat. Nos. 2,336,327; 2,360,290; 2,403,721; 2,701,197; 2,728,659; and 3,700,453) aminophenols, amines, gallic acid, catechol, ascorbic acid, hydrazides (e.g. U.S. Pat. No. 4,923,787), sulfonamidophenols (e.g. U.S. Pat. No. 4,447,523), and non color-forming couplers.

It is also contemplated that the concepts of the discussion may be employed to obtain reflection color prints as described in *Research Disclosure*, November 1979, Item 18716, incorporated herein by reference. The photographic element may contain epoxy solvents (EP 164,961); ballasted chelating agents such as those in U.S. Pat. No. 4,994,359 to reduce sensitivity to polyvalent cations such as calcium; and stain reducing compounds such as described in U.S. Pat. Nos. 5,068,171, 5,096,805, and 5,126,234. The particular base material utilized may be any material conventionally used in silver halide color papers. Such materials are disclosed in *Research Disclosure*, September 1994, Item 36544, Section XV. It may be desired to coat the photographic element on pH adjusted support as described in U.S. Pat. No. 4,917,994.

Due to a desire for rapid development and reduced impact on the environment, preferred emulsions for color paper elements of the invention are high in silver chloride. Typically, silver halide emulsions with greater than 90 mole % chloride are preferred, and even more preferred are emulsions of greater than 95 mole % chloride. In some instances, silver chloride emulsions containing small amounts of bromide, or iodide, or bromide and iodide are preferred, generally less than 5.0 mole % of bromide less than 2.0 mole % of iodide. Bromide or iodide addition when forming the emulsion may come from a soluble halide source such as potassium iodide or sodium bromide or an organic bromide or iodide or an inorganic insoluble halide such as silver bromide or silver iodide. Soluble bromide is also typically added to the emulsion melt as a keeping addendum. It is specifically contemplated to use [100] tabular grain silver chloride emulsions, as disclosed in U.S. Pat. No. 5,320,938, in conjunction with elements of the current invention.

Color paper elements typically contain less than 1.0 $g/m^2$ of total silver. Due to the need to decrease the environmental impact of color paper processing, it is desired to decrease the amount of total silver used in the element as much as possible. Therefore, total silver levels of less than 0.90 $g/m^2$ are preferable, and levels of 0.80 $g/m^2$ are even more preferable. It is possible to reduce further the total silver used in the color paper photographic element to less than 0.10 $g/m^2$ by use of a so-called development amplification process whereby the incorporated silver is used only to form the latent image, while another oxidant, such as hydrogen peroxide, serves as the primary oxidant to react with the color developer. Such processes are well-known to the art, and are described in, for example, U.S. Pat. Nos. 4,791,048; 4,880,725; and 4,954,425; EP 487,616; International published patent applications Nos. WO 90/013,059; 90/013,061; 91/016,666; 91/017,479; 92/001,972; 92/005,471; 92/007,299; 93/001,524; 93/011,460; and German published patent application OLS 4,211,460.

Photographic elements can be exposed to actinic radiation, typically in the visible region of the spectrum, to form a latent image and can then be processed to form a visible dye image. It is particularly advantageous for elements of the invention to be digitally exposed using methods such as scanning by lasers, light emitting diodes, cathode ray tubes, or liquid crystal displays. Exposure times are typically less than 1 millisecond, and more typically less than $10^{-5}$ seconds, such as the case with laser exposing devices. Processing to form a visible dye image includes the step of contacting the element with a color developing agent to reduce developable silver halide and oxidize the color developing agent. Oxidized color developing agent in turn reacts with the coupler to yield a dye. Elements of the invention can be processed by a method such as the RA-4 process of Eastman Kodak Company as is described in the *British Journal of Photography Annual* of 1988, pages 198–199.

Photographic color light-sensitive materials often utilize silver halide emulsions where the halide, for example chloride, bromide and iodide, is present as a mixture or combination of at least two halides. The combinations significantly influence the performance characteristics of the silver halide emulsion. As explained in Atwell, U.S. Pat. No. 4,269,927, silver halide with a high chloride content, that is, light-sensitive materials in which the silver halide grains are at least 80 mole percent silver chloride, possesses a number of highly advantageous characteristics. For example, silver chloride possesses less native sensitivity in the visible region of the spectrum than silver bromide, thereby permitting yellow filter layers to be omitted from multicolor photographic light-sensitive materials. However, if desired, the use of yellow filter layers should not be excluded from consideration for a light sensitive material. Furthermore, high chloride silver halides are more soluble than high bromide silver halide, thereby permitting development to be achieved in shorter times. Furthermore, the release of chloride into the developing solution has less restraining action on development compared to bromide and this allows developing solutions to be utilized in a manner that reduces the amount of waste developing solution.

Processing a silver halide color photographic light-sensitive material is basically composed of two steps of 1) color development and 2) desilvering. The desilvering stage comprises a bleaching step to change the developed silver back to an ionic-silver state and a fixing step to remove the ionic silver from the light-sensitive material. The bleaching and fixing steps can be combined into a monobath bleach-fix step that can be used alone or in combination with the bleaching and the fixing step. If necessary, additional processing steps may be added, such as a washing step, a stopping step, a stabilizing step and a pretreatment step to accelerate development. The processing chemicals used may be liquids, pastes, or solids, such as powders, tablets or granules.

In color development, silver halide that has been exposed to light is reduced to silver, and at the same time, the oxidized aromatic primary amine color developing agent is consumed by the above mentioned reaction to form image dyes. In this process halide ions from the silver halide grains are dissolved into the developer, where they will accumulate. In addition the color developing agent is consumed by the afore-mentioned reaction of the oxidized color developing agent with the coupler. Furthermore, other components in the color developer will also be consumed and the concentration will gradually be lowered as additional development occurs. In a batch-processing method, the performance of the developer solution will eventually be degraded as a result of the halide ion build-up and the consumption of developer components. Therefore, in a development method that continuously processes a large amount of a silver halide photographic light-sensitive material, for example by automatic-developing processors, in order to avoid a change in the finished photographic characteristics caused by the change in the concentrations of the components, some means is required to keep the concentrations of the components of the color developer within certain ranges.

For instance, a developer solution in a processor tank can be maintained at a 'steady-state concentration' by the use of another solution that is called the replenisher solution. By metering the replenisher solution into the tank at a rate proportional to the amount of the photographic light-sensitive material being developed, components can be maintained at an equilibrium within a concentration range that will give good performance. For the components that are consumed, such as the developing agents and preservatives, the replenisher solution is prepared with the component at a concentration higher than the tank concentration. In some cases a material will leave the emulsions layers that will have an effect of restraining development, and will be present at a lower concentration in the replenisher or not present at all. In other cases a material may be contained in a replenisher in order to remove the influence of a materials that will wash out of the photographic light-sensitive material. In other cases, for example, the buffer, or the concentration of a chelating agent where there may be no consumption, the component in the replenisher is the same or similar concentration as in the processor tank. Typically the replenisher has a higher pH to account for the acid that is released during development and coupling reactions so that the tank pH can be maintained at an optimum value.

Similarly, replenishers are also designed for the secondary bleach, fixer and stabilizer solutions. In addition to additions for components that are consumed, components are added to compensate for the dilution of the tank which occurs when the previous solution is carried into the tank by the photographic light-sensitive material.

The following processing steps may be included in the preferable processing steps carried out in the method in which a processing solution is applied:

1) color developing→bleach-fixing→washing/stabilizing;
2) color developing→bleaching→fixing→washing/stabilizing;
3) color developing→bleaching→bleach-fixing→washing/stabilizing;
4) color developing→stopping→washing→bleaching→washing→fixing→washing/stabilizing;
5) color developing→bleach-fixing→fixing→washing/stabilizing;
6) color developing→bleaching→bleach-fixing→fixing→washing/stabilizing.

Among the processing steps indicated above, the steps 1) and 2) are preferably applied. Additionally, each of the steps indicated can be used with multistage applications as described in Hahm, U.S. Pat. No. 4,719,173, with co-current, counter-current, and contraco arrangements for replenishment and operation of the multistage processor.

The color developing solution used with this photographic element may contain aromatic primary amine color developing agents, which are well known and widely used in a variety of color photographic processes. Preferred examples are p-phenylenediamine derivatives. They are usually added to the formation in a salt form, such as the hydrochloride, sulfate, sulfite, p-toluene-sulfonate, as the salt form is more stable and has a higher aqueous solubility than the free amine. Among the salts listed the p-toluenesulfonate is rather useful from the viewpoint of making a color developing agent highly concentrated. Representative examples are given below, but they are not meant to limit what could be used with the present photographic element:

4-amino-3-methyl-N-ethyl-N-(β-hydroxyethyl)aniline sulfate, 4-amino-3-methyl-N-ethyl-N-(β-(methanesulfonamidoethyl)aniline sesquisulfate hydrate, 4-amino-N,N-diethylanline hydrochloride, 4-amino-3-methyl-N,N-diethylaniline hydrochloride, 4-amino-3-β-(methanesulfonamido)ethyl-N,N-diethylaniline hydrochloride and 4-amino-N-ethyl-N-(2-methoxyethyl)-m-toluidine di-p-toluene sulfonic acid.

Among the above-mentioned color developing agents, 4-amino-3-methyl-N-ethyl-N-(β-(methanesulfonamidoethyl)aniline sesquisulfate hydrate preferably is used. There may be some instances where the above mentioned color developing agents may be used in combination so that they meet the purposes of the application.

Any photographic processor known to the art can be used to process the photosensitive materials described herein. For instance, large volume processors, and so-called minilab and microlab processors may be used. Particularly advantageous would be the use of Low Volume Thin Tank processors as described in the following references: WO 92/10790; WO 92/17819; WO 93/04404; WO 92/17370; WO 91/19226; WO 91/12567; WO 92/07302; WO 93/00612; WO 92/07301; WO 92/09932; U.S. Pat. No. 5,294,956; EP 559,027; U.S. Pat. No. 5,179,404; EP 559,025; U.S. Pat. No. 5,270,762; EP 559,026; U.S. Pat. No. 5,313,243; U.S. Pat. No. 5,339,131.

It has been found that the following layer structure provides the unexpected benefits of the invention.

| Conventional Structure | Inventive Structure |
|---|---|
| | Interlayer |
| Interlayer | Enhancer Layer |
| Emulsion + Coupler Dispersion | Emulsion + Coupler Dispersion |

In this invention, an extra enhancer layer is situated between a conventional color forming layer that contains both a coupler dispersion and a light sensitive silver halide emulsion and an interlayer which contains an anticolor-mixing agent. In a preferred embodiment, no additional coupler is used in the photographic element. Rather, the amount of coupler used in the conventional light sensitive layer is reduced by the amount of coupler added to the enhancer layer.

The magnitude of the beneficial effects obtained by use of the invention are dependent on coupler reactivity, emulsion grain size, emulsion halide content, and the relative amounts of coupler used in the photosensitive layer and in the enhancer layer, among other things.

Although any coupler can be used, as coupler reactivity goes up, the magnitude of the inventive effects is diminished. Additionally, the advantages of this invention are observed to be greater with increasing grain size. Generally, grain sizes are preferably in the range of 0.5 to 2.5 μm, and more preferably in the range of 0.6 to 2.0 μm, and even more preferably in the range of 0.7 to 1.5 μm. Below a grain size of around 0.5 μm little benefit is observed with the use of the inventive structure.

For the reasons mentioned above, silver halide emulsions with greater than 90 mole % chloride are preferred, and even more preferred are emulsions of greater than 95 mole % chloride. In some instances, silver chloride emulsions containing small amounts of bromide, or iodide, or bromide and iodide are preferred, generally less than 5.0 mole % of bromide less than 2.0 mole % of iodide. In addition, the inclusion of substantial amounts of bromide and/or iodide would tend to reduce the developability of the emulsion, and thereby reduce the magnitude of the inventive effect.

The enhancer layer preferably contains between 15–50% of the coupler dispersion that normally would have been used in the photosensitive layer. More preferably, this range is between 30–40% of the total amount of coupler in both the photosensitive layer and the enhancer layer.

In a preferred embodiment of the invention, the enhancer layer contains a yellow coupler and it is situated between a conventional blue sensitive layer and a Dox scavenging interlayer. This enhancing layer is comprised of gelatin and coupler and does not contain a significant amount of silver halide light sensitive emulsion. The enhancer layer may also include coupler solvents, stabilizers, and other materials such as coating aids.

| Conventional Structure | Inventive Structure |
|---|---|
| | Soc |
| Soc | UV Absorbing Layer |
| UV Absorbing Layer | Red Sensitive Layer |
| Red Sensitive Layer | UV Absorbing Interlayer |
| UV Absorbing Interlayer | Green Sensitive Layer |
| Green Sensitive Layer | Interlayer |
| Interlayer | Enhancer Layer |
| Blue Sensitive Layer | Blue Sensitive Layer |
| Reflective Support | Reflective Support |

In the above invention structure, SOC stands for simultaneous overcoat layer, which is typically present as a protective layer for the photographic element. Further, the UV Absorbing Interlayer typically is comprised of both ultraviolet absorbing materials and one or more anticolor-mixing agents to prevent cross-talk between the red and green sensitive-layers.

The following examples illustrate the practice of this invention. They are not intended to be exhaustive of all possible variations of the invention. Parts and percentages are by weight unless otherwise indicated.

EXAMPLES

Example 1

Silver chloride emulsions were chemically and spectrally sensitized as is described below.

Blue Sensitive Emulsion (Blue EM-1, prepared similarly to that described in U.S. Pat. No. 5,252,451, column 8, lines 55–68): A high chloride silver halide emulsion was precipitated by adding approximately equimolar silver nitrate and sodium chloride solutions into a well-stirred reactor containing gelatin peptizer and thioether ripener. $Cs_2Os$ (NO) $Cl_5$ dopant was added during the silver halide grain formation for most of the precipitation, followed by a shelling without dopant. The resultant emulsion contained cubic shaped grains of 0.76 μm in edgelength size. This emulsion was optimally sensitized by the addition of a colloidal suspension of aurous sulfide and heat ramped up to 60° C. during which time blue sensitizing dye BSD-4, 1-(3-acetamidophenyl)-5-mercaptotetrazole and potassium bromide were added. In addition, iridium dopant was added during the sensitization process.

Blue Sensitive Emulsion (Blue EM-2): A high chloride silver halide <100> tabular grain emulsion was precipitated according to the procedures described above and optimally sensitized by the addition of glutaramidophenyl disulfide followed by an optimum amount of colloidal suspension of aurous sulfide and blue sensitizing dye BSD-4. After digestion at 40° C., Lippmann bromide, containing small amount of potassium hexachloroiridate, was added to the emulsion and it was heated to 55° C. and held at this temperature for 40 minutes. Upon cooling back to 40° C., an appropriate amount of 1-(3-acetamidophenyl)-5-mercaptotetrazole was added.

Green Sensitive Emulsion (Green EM-1): A high chloride silver halide emulsion was precipitated by adding approximately equimolar silver nitrate and sodium chloride solutions into a well-stirred reactor containing gelatin peptizer and thioether ripener. $Cs_2Os(NO)Cl_5$ dopant was added during the silver halide grain formation for most of the precipitation, followed by a shelling without dopant. The resultant emulsion contained cubic shaped grains of 0.30 $\mu$m in edgelength size. This emulsion was optimally sensitized by addition of a colloidal suspension of aurous sulfide, heat digestion, followed by the addition of iridium dopant, Lippmann bromide/1-(3-acetamidophenyl)-5-mercaptotetrazole, green sensitizing dye GSD-1, and 1-(3-acetamidophenyl)-5-mercaptotetrazole.

Red Sensitive Emulsion (Red EM-1): A high chloride silver halide emulsion was precipitated by adding approximately equimolar silver nitrate and sodium chloride solutions into a well-stirred reactor containing gelatin peptizer and thioether ripener. The resultant emulsion contained cubic shaped grains of 0.40 $\mu$m in edgelength size. This emulsion was optimally sensitized by the addition of a colloidal suspension of aurous sulfide followed by a heat ramp, and further additions of 1-(3-acetamidophenyl)-5-mercaptotetrazole, potassium bromide and red sensitizing dye RSD-1. In addition, iridium and ruthenium dopants were added during the sensitization process.

Coupler dispersions were emulsified by methods well known to the art, and the following layers were coated on a polyethylene resin coated paper support, that was sized as described in U.S. Pat. 4,994,147 and pH adjusted as described in U.S. Pat. 4,917,994. The polyethylene layer coated on the emulsion side of the support contained a mixture of 0.1% (4,4'-bis(5-methyl-2-benzoxazolyl) stilbene and 4,4'-bis(2-benzoxazolyl) stilbene, 12.5% $TiO_2$, and 3 % ZnO white pigment. The layers were hardened with bis (vinylsulfonyl methyl) ether at 2.4% of the total gelatin weight.

| | g/m$^2$ |
|---|---|
| BL-1: Blue Sensitive Layer | |
| Gelatin | 1.506 |
| Blue Sensitive Silver (Blue EM-1) | 0.301 |
| Y-1 | 1.076 |
| ST-6 | 0.258 |
| Dibutyl phthalate | 0.355 |
| 2-(2-butoxyethoxy)ethyl acetate | 0.301 |
| BL-2: Blue Sensitive Layer | |
| Gelatin | 1.506 |
| Blue Sensitive Silver (Blue EM-1) | 0.440 |
| Y-1 | 1.076 |
| ST-6 | 0.258 |
| Dibutyl phthalate | 0.355 |
| 2-(2-butoxyethoxy)ethyl acetate | 0.301 |
| BL-3: Blue Sensitive Layer | |
| Gelatin | 1.219 |
| Blue Sensitive Silver (Blue EM-1) | 0.301 |
| Y-1 | 0.753 |
| ST-6 | 0.181 |
| Dibutyl phthalate | 0.248 |
| 2-(2-butoxyethoxy)ethyl acetate | 0.211 |
| BL-4: Blue Sensitive Layer | |
| Gelatin | 1.219 |
| Blue Sensitive Silver (Blue EM-1) | 0.440 |
| Y-1 | 0.753 |
| ST-6 | 0.181 |
| Dibutyl phthalate | 0.248 |
| 2-(2-butoxyethoxy)ethyl acetate | 0.211 |
| EL-1: Enhancer Layer | |
| Gelatin | 0.287 |
| Y-1 | 0.323 |
| ST-6 | 0.077 |
| Dibutyl phthalate | 0.106 |
| 2-(2-butoxyethoxy)ethyl acetate | 0.090 |
| IL-1: Interlayer | |
| Gelatin | 0.753 |
| 2,5-Di-tert-octyl hydroquinone | 0.066 |
| Dibutyl phthalate | 0.188 |
| Disodium 4,5 Dihydroxy-m-benzenedisulfonate | 0.065 |
| SF-1 | 0.011 |
| Irganox 1076 ™ | 0.010 |
| GL-1: Green Sensitive Layer | |
| Gelatin | 1.238 |
| Green Sensitive Silver | 0.317 |
| CM-1 | 0.420 |
| Dibutyl phthalate | 0.260 |
| Irganox 1076 ™ | 0.030 |
| ST-8 | 0.113 |
| ST-21 | 0.113 |
| ST-22 | 0.195 |
| GL-2: Green Sensitive Layer | |
| Gelatin | 1.238 |
| Green Sensitive Silver | 0.317 |
| M-2 | 0.291 |
| Dibutyl phthalate | 0.260 |
| Irganox 1076 ™ | 0.030 |
| ST-8 | 0.113 |
| ST-21 | 0.113 |
| ST-22 | 0.195 |
| GL-3: Green Sensitive Layer | |
| Gelatin | 1.238 |
| Green Sensitive Silver | 0.179 |
| M-2 | 0.291 |
| Dibutyl phthalate) | 0.260 |
| Irganox 1076 ™ | 0.030 |
| ST-8 | 0.113 |
| ST-21 | 0.113 |
| ST-22 | 0.195 |
| UV-1: UV Interlayer | |
| Gelatin | 0.736 |
| UV-1 | 0.033 |
| UV-2 | 0.187 |
| 2,5-Di-tert-octyl hydroquinone | 0.055 |
| Dibutyl phthalate | 0.037 |
| 1,4-Cyclohexylenedimethylene bis(2-ethylhexanoate) | 0.037 |
| RL-1 Red Sensitive Layer | |
| Gelatin | 1.421 |
| Red Sensitive Silver (Red EM-1) | 0.296 |
| C-1 | 0.423 |
| Dibutyl phthalate | 0.414 |
| UV-2 | 0.272 |
| 2-(2-butoxyethoxy)ethyl acetate | 0.035 |
| 2,5-Di-tert-octyl hydroquinone | 0.005 |
| Potassium tolylthiosulfonate | 0.003 |
| Potassium tolylsulfinate | 0.0003 |

-continued
| | g/m$^2$ |
|---|---|
| UV-2: UV Overcoat | |
| Gelatin | 0.510 |
| UV-1 | 0.023 |
| UV-2 | 0.130 |
| 2,5-Di-tert-octyl hydroquinone | 0.938 |
| Dibutyl phthalate | 0.026 |
| 1,4-Cyclohexylenedimethylene bis(2-ethylhexanoate) | 0.026 |
-continued
| | g/m$^2$ |
|---|---|
| S-1: SOC | |
| Gelatin | 1.076 |
| 2,5-Di-tert-octyl hydroquinone | 0.013 |
| Dibutyl phthalate | 0.039 |
| SF-1 | 0.009 |
| SF-2 | 0.004 |
STRUCTURES
BSD-1
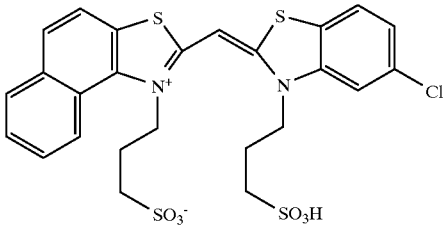
GSD-1
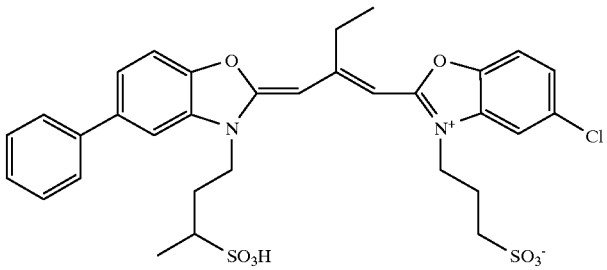
RSD-1
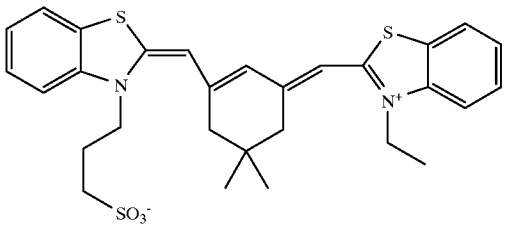
Y-1
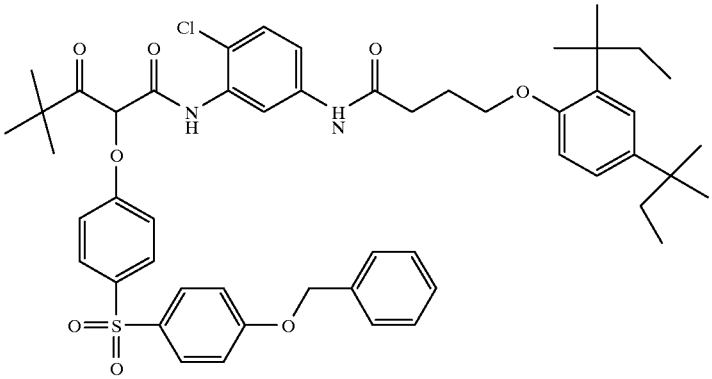

-continued
Y-5
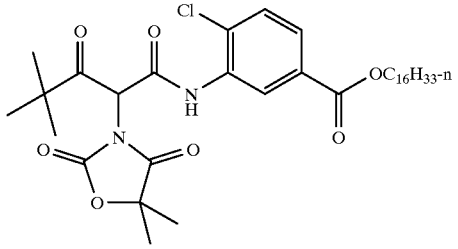
M-2
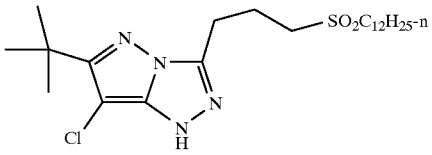
C-1
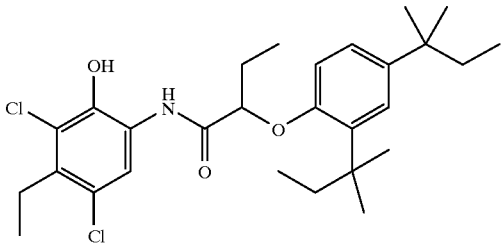
ST-6
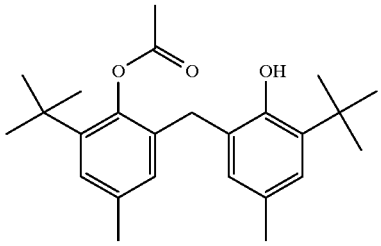
ST-8
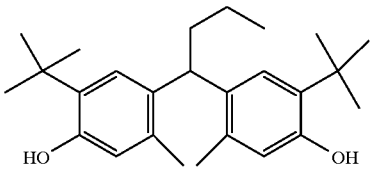
ST-21
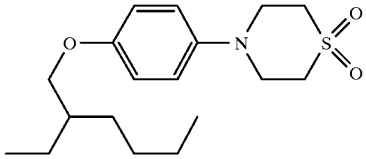
ST-5
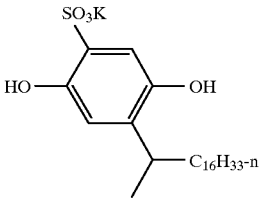
ST-22
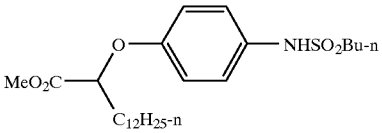
DYE-1
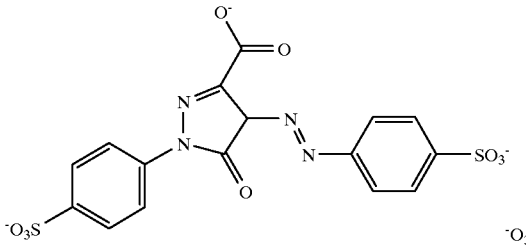
DYE-2
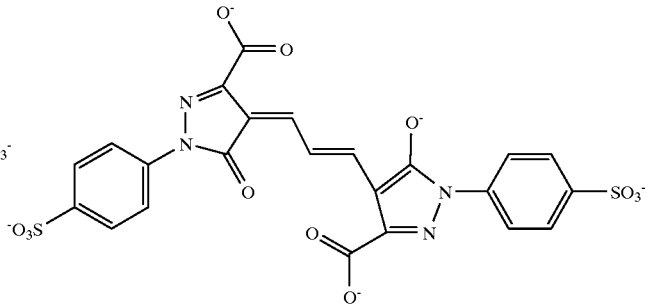

-continued

DYE-3

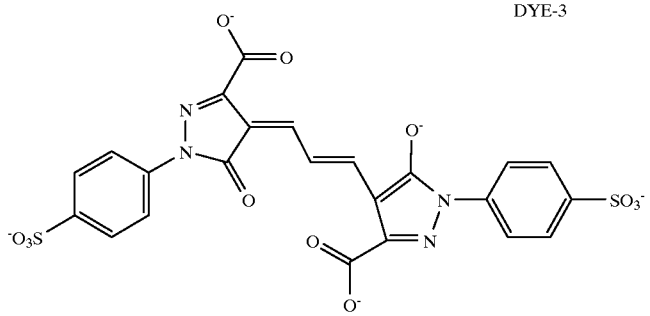

UV-1

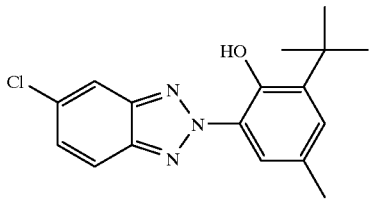

UV-2

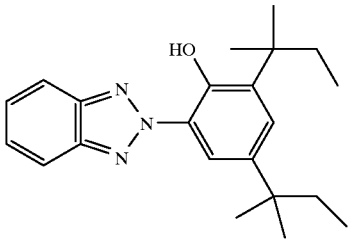

SF-1

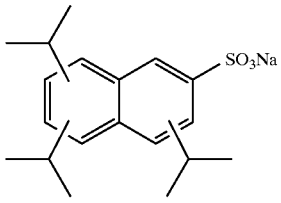

SF-2

$CF_3 \cdot (CF_2)_7 \cdot SO_3Na$

SF-12

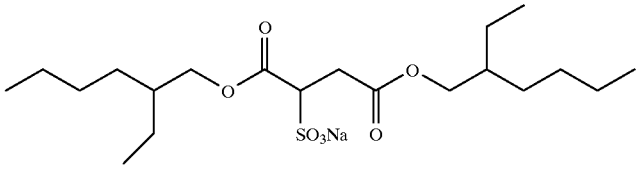

The following structures are provided for the comparison examples:

CM-1

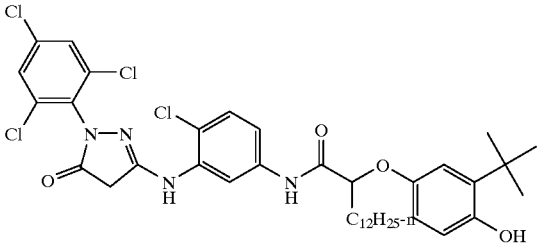

Coatings 1-1 through 1-8 were prepared according to the structure shown in Table 1.

TABLE 1

| Coating | Comment | SOC | UV | RL | UV | GL | IL | EL | BL |
|---|---|---|---|---|---|---|---|---|---|
| 1-1 | Comparison | S-1 | UV-2 | R-1 | UV-1 | G-1 | IL-1 | None | BL-1 |
| 1-2 | Comparison | S-1 | UV-2 | R-1 | UV-1 | G-2 | IL-1 | None | BL-1 |
| 1-3 | Comparison | S-1 | UV-2 | R-1 | UV-1 | G-3 | IL-1 | None | BL-1 |
| 1-4 | Comparison | S-1 | UV-2 | R-1 | UV-1 | G-3 | IL-1 | None | BL-2 |
| 1-5 | Comparison | S-1 | UV-2 | R-1 | UV-1 | G-1 | IL-1 | EL-1 | BL-3 |
| 1-6 | Comparison | S-1 | UV-2 | R-1 | UV-1 | G-2 | IL-1 | EL-1 | BL-3 |
| 1-7 | Comparison | S-1 | UV-2 | R-1 | UV-1 | G-3 | IL-1 | EL-1 | BL-3 |
| 1-8 | Invention | S-1 | UV-2 | R-1 | UV-1 | G-3 | IL-1 | EL-1 | BL-4 |

The coatings were given a red, green and blue stepped exposure and processes through the Kodak RA-4 process, described in the *British Journal of Photography Annual* of 1988, pp 190–199, comprising the following processing solutions, times and temperatures to give the results shown in Table 2.

| | | |
|---|---|---|
| Developer | 45 sec | 35° C. |
| Bleach-Fix | 45 sec | 35° C. |
| Wash | 1 min, 30 sec | 33–34° C. |

TABLE 2

| Coating | Comment | Total Silver g/m$^2$ | Relative Green Shoulder | Relative Blue Shoulder | Relative Green Density at Blue Density of 2.00 |
|---|---|---|---|---|---|
| 1-1 | Comparison | 0.915 | Check | Check | Check |
| 1-2 | Comparison | 0.915 | 0.48 | 0.00 | 0.00 |
| 1-3 | Comparison | 0.776 | 0.00 | 0.02 | 0.00 |
| 1-4 | Comparison | 0.915 | 0.02 | 0.17 | 0.00 |
| 1-5 | Comparison | 0.915 | 0.01 | −0.02 | −0.01 |
| 1-6 | Comparison | 0.915 | 0.49 | 0.00 | −0.01 |
| 1-7 | Comparison | 0.776 | 0.05 | 0.00 | −0.01 |
| 1-8 | Invention | 0.915 | 0.06 | 0.16 | −0.01 |

Status A blue shoulder density was obtained from the D log E curve. It is defined as the density measured at 0.40 log exposure beyond the log exposure point at 0.8 density. The Relative Blue Shoulder Density is the difference in shoulder density obtained for elements of the invention relative to a check coating.

The comparative example variation 1-1 is deficient in performance in several ways. The blue shoulder of this variation is low relative to the red and the green shoulder, when given a laser exposure of 1 microsecond duration. This results in an inferior reproduction of text and sharp transitions from black to white. These transitions appear yellow in color due to the relatively low blue shoulder. This variation is also deficient in color reproduction. Specifically, colors which are formed from magenta dye or some combination of magenta and/or yellow and cyan dyes. This is due to the light absorptance properties of the magenta image dye.

The magenta dye is improved in variation 1-2, resulting in an improvement in color reproduction for colors which are formed from magenta dye or some combination of magenta and/or yellow and cyan image dyes. Due to the efficiency of this coupler class in forming magenta dye, the green shoulder is now too high. This results in an inferior reproduction of text and sharp transitions from black to white. These transitions would appear yellow/green in color due to the relatively high green shoulder and the relatively low blue shoulder.

The green shoulder is lowered in variation 1-3 by lowering the silver coverage in the magenta layer. This silver is then placed in the yellow layer in variation 1-4. The blue shoulder is now improved, which results in improved reproduction of text and sharp transitions from black to white. These transitions now appear neutral in color, which makes them look brighter and crisper.

Color contamination is measured by the green density of a blue separation exposure, developed to a blue density of 2.00. This makes yellows appear red in color at high densities. Variations 1-5, 1-6, 1-7, 1-8 all employ a color enhancer layer which lowers the degree of chemical contamination. Variation 1-5 is relatively low in blue shoulder and has inferior magenta image dye absorption, variation 1-6 is relatively high in green shoulder and relatively low in blue shoulder, and variation 1-7 is relatively low in blue shoulder. The inventive variation 1-8 utilizes all aspects of this invention, and would result in the most pleasing image for color reproduction and text clarity. The improvement resulting from the use of the color enhancer layer can be demonstrated by comparing variation 1-8 to variation 1-4. The reduction in green density of a blue separation exposure, developed to a blue density of 2.00 is clearly evident. It should be noted that it takes a very small amount of magenta dye to contaminate a pure yellow color.

Example 2

Example 2 was prepared identically to Example 1 except for the following unique layer formulations:

| | g/m$^2$ |
|---|---|
| BL-5: Blue Sensitive Layer | |
| Gelatin | 0.994 |
| Blue Sensitive Silver (Blue EM-1) | 0.440 |
| Y-1 | 0.323 |
| ST-6 | 0.181 |
| Dibutyl phthalate | 0.248 |
| 2-(2-butoxyethoxy)ethyl acetate | 0.211 |
| BL-6: Blue Sensitive Layer | |
| Gelatin | 1.287 |
| Blue Sensitive Silver (Blue EM-1) | 0.440 |
| Y-1 | 0.753 |
| ST-6 | 0.181 |
| Dibutyl phthalate | 0.248 |
| 2-(2-butoxyethoxy)ethyl acetate | 0.211 |
| BL-7: Blue Sensitive Layer | |
| Gelatin | 1.067 |
| Blue Sensitive Silver (Blue EM-1) | 0.440 |
| Y-1 | 0.430 |
| ST-6 | 0.181 |
| Dibutyl phthalate | 0.248 |
| 2-(2-butoxyethoxy)ethyl acetate | 0.211 |
| BL-8: Blue Sensitive Layer | |
| Gelatin | 1.214 |
| Blue Sensitive Silver (Blue EM-1) | 0.440 |
| Y-1 | 0.646 |
| ST-6 | 0.181 |
| Dibutyl phthalate | 0.248 |
| 2-(2-butoxyethoxy)ethyl acetate | 0.211 |
| BL-9: Blue Sensitive Layer | |
| Gelatin | 1.123 |
| Blue Sensitive Silver (Blue EM-1) | 0.440 |
| Y-1 | 0.646 |
| ST-6 | 0.181 |
| Dibutyl phthalate | 0.248 |
| 2-(2-butoxyethoxy)ethyl acetate | 0.211 |
| EL-2: Enhancer Layer | |
| Gelatin | 0.512 |
| Y-1 | 0.753 |
| ST-6 | 0.077 |
| Dibutyl phthalate | 0.106 |
| 2-(2-butoxyethoxy)ethyl acetate | 0.090 |
| EL-3: Enhancer Layer | |
| Gelatin | 0.220 |
| Y-1 | 0.323 |
| ST-6 | 0.017 |
| Dibutyl phthalate | 0.106 |
| 2-(2-butoxyethoxy)ethyl acetate | 0.090 |
| EL-4: Enhancer Layer | |
| Gelatin | 0.439 |
| Y-1 | 0.646 |
| ST-6 | 0.077 |
| Dibutyl phthalate | 0.106 |
| 2-(2-butoxyethoxy)ethyl acetate | 0.090 |
| EL-5: Enhancer Layer | |
| Gelatin | 0.293 |
| Y-1 | 0.430 |
| ST-6 | 0.077 |
| Dibutyl phthalate | 0.106 |
| 2-(2-butoxyethoxy)ethyl acetate | 0.090 |
| EL-7 Enhancer Layer | |
| Gelatin | 0.383 |
| Y-1 | 0.430 |
| ST-6 | 0.077 |
| Dibutyl phthalate | 0.106 |
| 2-(2-butoxyethoxy)ethyl acetate | 0.090 |

Coatings 2-1 through 2-8 were prepared according to the structure shown in Table 3.

TABLE 3

| Coating | Comment | SOC | UV | RL | UV | GL | IL | EL | BL |
|---|---|---|---|---|---|---|---|---|---|
| 2-1 | Comparison | S-1 | UV-2 | R-1 | UV-1 | G-3 | IL-1 | None | BL-2 |
| 2-2 | Comparison | S-1 | UV-2 | R-1 | UV-1 | G-3 | IL-1 | EL-2 | BL-5 |
| 2-3 | Invention | S-1 | UV-2 | R-1 | UV-1 | G-3 | IL-1 | EL-3 | BL-6 |
| 2-4 | Comparison | S-1 | UV-2 | R-1 | UV-1 | G-3 | IL-1 | EL-4 | BL-7 |
| 2-5 | Invention | S-1 | UV-2 | R-1 | UV-1 | G-3 | IL-1 | EL-5 | BL-8 |
| 2-6 | Comparison | S-1 | UV-2 | R-1 | UV-1 | G-3 | IL-1 | None | BL-2 |
| 2-7 | Invention | S-1 | UV-2 | R-1 | UV-1 | G-3 | IL-1 | EL-7 | BL-9 |
| 2-8 | Invention | S-1 | UV-2 | R-1 | UV-1 | G-3 | IL-1 | EL-1 | BL-4 |

The coatings were exposed and processed as in Example 1, with the results shown in Table 4.

Shoulder is the density measured at 0.40 log exposure beyond the log exposure point at 0.8 density. Relative green density at blue density of 2.00 or 2.20 refers to the green density of a blue separation exposure at specific blue densities. This is a measure of the optical purity of the yellow dye combined with any magenta dye created by the unwanted contamination of oxidized developer from the blue layer to the green layer.

These coatings were also subjected in the dry unexposed state to a dry pressure test. The photographic element was treated by scribing the surface of the paper at 31.5 meters per minute with a stylus upon having a round end about 1 mm in diameter upon which was placed a 40 g weight to give a series of lines about 1 cm apart. The element was then given a 21-step neutral exposure and processed as described above. The % blue density change was then obtained by comparing the blue density in the scribed area versus the blue density of an unscribed area, both in the minimum density area of the paper. This pressure can fog or sensitize an emulsion when not adequately protected by sufficient gelatin support. Percent density change with abrasion refers to the change in density of a sample when abraded prior to any exposure.

TABLE 4

| Coating | Comment | Relative Blue Shoulder | Relative Green Density at Blue Density of 2.00 | Relative Green Density at Blue Density of 2.20 | % Blue Density Change with Abrasion | Blue Layer Gel Laydown ($g/m^2$) |
|---|---|---|---|---|---|---|
| 2-1 | Comparison | Check | Check | Check | 2 | 1.51 |
| 2-2 | Comparison | −0.09 | 0.00 | 0.00 | 11 | 0.99 |
| 2-3 | Invention | 0.01 | −0.02 | −0.03 | 3 | 1.29 |
| 2-4 | Comparison | −0.08 | 0.00 | 0.00 | 7 | 1.07 |
| 2-5 | Invention | 0.00 | −0.01 | −0.02 | 3 | 1.21 |
| 2-6 | Comparison | Check | Check | Check | 1 | 1.51 |
| 2-7 | Invention | 0.00 | −0.02 | −0.04 | 2 | 1.12 |
| 2-8 | Invention | 0.02 | −0.02 | −0.04 | 1 | 1.22 |

From Table 4 it is clear that there is an optimum split of yellow coupler between the Enhancer Layer and the Blue Layer. In this Table only comparisons between members of each of the two sets of comparisons 2-1-2-5 and 2-6-2-8 should be considered. The numbers for the shoulder column and relative density columns are in comparison to the value of the comparison in each group. Coatings 2-3 and 2-5 have yellow coupler in the enhancer layer comprise 50% or less of the total yellow coupler in the element, which results in LOWER relative green density at a blue density of 2.00 with no loss in relative blue shoulder. Coatings 2-2 and 2-4 both suffer from poor blue shoulder density due to an insufficient amount of coupler present in the same layer as the emulsion.

It is also evident when comparing % blue density change with abrasion that coatings 2-2 and 2-4 and are clearly inferior to the comparison. This can be correlated to the total gelatin coverage in the blue layer, which should be greater than 1.10 $g/m^2$ for optimum results.

Example 3

Example 3 was prepared identically to Example 1 except for the following unique layer formulations:

| | $g/m^2$ |
|---|---|
| BL-11: Blue Sensitive Layer | |
| Gelatin | 1.506 |
| Blue Sensitive Silver (Blue EM-2) | 0.387 |
| Y-1 | 1.076 |
| ST-6 | 0.258 |
| Dibutyl phthalate | 0.355 |
| 2-(2-butoxyethoxy)ethyl acetate | 0.301 |

-continued

| | $g/m^2$ |
|---|---|
| BL-12: Blue Sensitive Layer | |
| Gelatin | 1.219 |
| Blue Sensitive Silver (Blue EM-2) | 0.387 |
| Y-1 | 0.753 |
| ST-6 | 0.258 |
| Dibutyl phthalate | 0.355 |
| 2-(2-butoxyethoxy)ethyl acetate | 0.301 |

Coatings 3-1 and 3-2 were prepared according to the structure shown in Table 5.

TABLE 5

| Coating | Comment | SOC | UV | RL | UV | GL | IL | EL | BL |
|---|---|---|---|---|---|---|---|---|---|
| 3-1 | Comparison | S-1 | UV-2 | R-1 | UV-1 | G-3 | IL-1 | None | BL-11 |
| 3-2 | Invention | S-1 | UV-2 | R-1 | UV-1 | G-3 | IL-1 | EL-1 | BL-12 |

The coatings were exposed and processed as in Example 1, with the results shown in Table 6.

TABLE 6

| Coating | Comment | Relative Blue Shoulder | Relative Green Density at Blue Density of 2.00 | Relative Green Density at Blue Density of 2.20 |
|---|---|---|---|---|
| 3-1 | Comparison | Check | Check | Check |
| 3-2 | Invention | 0.01 | −0.01 | −0.01 |

From Table 6 is is clear that the inventive combination offers lower chemical contamination with no loss in relative blue shoulder for a tabular emulsion grain utilized in the blue layer.

Example 4

Example 4 was prepared identically to Example 1 except for the following unique layer formulations:

| | g/m$^2$ |
|---|---|
| BL-13: Blue Sensitive Layer | |
| Gelatin | 1.506 |
| Blue Sensitive Silver (Blue EM-2) | 0.387 |
| Y-5 | 0.699 |
| Dibutyl phthalate | 0.315 |
| BL-14: Blue Sensitive Layer | |
| Gelatin | 1.219 |
| Blue Sensitive Silver (Blue EM-2) | 0.387 |
| Y-5 | 0.490 |
| Dibutyl phthalate | 0.220 |

Coatings 4-1 and 4-2 were prepared according to the structure shown in Table 7.

TABLE 7

| Coating | Comment | SOC | UV | RL | UV | GL | IL | EL | BL |
|---|---|---|---|---|---|---|---|---|---|
| 4-1 | comparison | S-1 | UV-2 | R-1 | UV-1 | G-3 | IL-1 | None | BL-13 |
| 4-2 | invention | S-1 | UV-2 | R-1 | UV-1 | G-3 | IL-1 | EL-8 | BL-14 |

The coatings were exposed and processed as in Example 1, with the results shown in Table 8.

TABLE 8

| Coating | Comment | Relative Blue Shoulder | Relative Green Density at Blue Density of 2.00 | Relative Green Density at Blue Density of 2.20 |
|---|---|---|---|---|
| 4-1 | Comparison | Check | Check | Check |
| 4-2 | Invention | 0.03 | −0.07 | −0.10 |

From Table 8 it is clear that the inventive combination offers significantly lower chemical contamination with no loss in relative blue shoulder for a tabular emulsion grain and the yellow coupler Y-5 utilized in the blue layer.

The invention has been described in detail with particular reference to preferred embodiments thereof, but it will be understood that variations and modifications can be effected within the spirit and scope of the invention.

I claim:

1. A photographic element comprising an emulsion layer comprising a cyan dye forming coupler, an emulsion layer comprising a magenta dye forming coupler, an emulsion layer comprising a yellow dye forming coupler wherein said magenta coupler is selected from the group consisting of P-1 and P-2

P-1

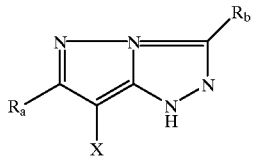

P-2

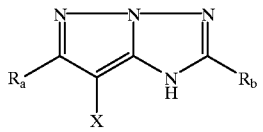

wherein $R_a$ and $R_b$ independently represent H or a substituent; X is hydrogen or a coupling-off group; and $Z_a$, $Z_b$, and $Z_c$ are independently a substituted methine group, =N—, =C—, or —NH—, provided that one of either the $Z_a$—$Z_b$ bond or the $Z_b$—$Z_c$ bond is a double bond and the other is a single bond, and when the $Z_b$—$Z_c$ bond is a carbon-carbon double bond, it may form part of an aromatic ring, and at least one of $Z_a$; $Z_b$, and $Z_c$ represents a methine group connected to the group $R_b$, and wherein between said yellow dye forming layer and said magenta dye forming layer, there is located at least one color enhancer layer comprising gelatin and said yellow dye forming coupler said enhancer layer being substantially free of silver halide, wherein said yellow coupler in said color enhancer layer comprises less than 50% of the total yellow coupler in said element and wherein said element further comprises a gelatin containing anticolor-mixing layer free of yellow coupler and silver halide, between said magenta dye forming coupler containing layer and said color enhancer layer containing dye forming coupler.

2. The photographic element of claim 1 wherein said yellow coupler in said color enhancer layer comprises greater than 15% of the total yellow coupler in said element.

3. The photographic element of claim 1 wherein said yellow coupler in said color enhancer layer comprises between about 30 and 40% of the total yellow coupler in said element.

4. The photographic element of claim 1 wherein said magenta coupler comprises

M-2

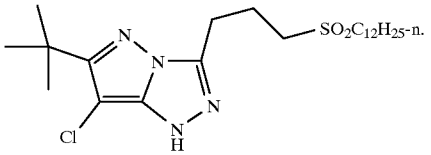

5. The element of claim 1 wherein the molar ratio of blue light sensitive silver to total yellow coupler in said element is between about 3.0 and 6.0.

6. The element of claim 1 wherein said emulsion layer containing yellow dye forming coupler comprises between 0.3 to 0.5 g/m$^2$ of silver.

7. The element of claim 1 wherein X is not a hydrogen.

8. The element of claim 1 wherein the total silver in said element is greater than 0.7 g/m$^2$.

9. The element of claim 1 wherein said anticolor-mixing layer comprises an oxidized developer scavenger.

10. The element of claim 9 wherein said developer scavenger comprises at least one material selected from the group consisting of hydroquinones, hydrazides, and sulfonamidophenols.

11. The element of claim 9 wherein said developer scavenger comprises 2,5-di-tert-octyl hydroquinone.

12. The element of claim 9 wherein the ratio of gelatin to other organic materials in said anticolor-mixing layer is between about 1.5 and 6.0.

13. The element of claim 12 wherein the ratio of gelatin to other organic materials in said anticolor-mixing layer is between about 2.5 and 5.0.

14. The photographic element of claim 1 wherein said emulsion layer containing yellow dye forming coupler comprises gelatin in an amount of at least 1.10 g/m$^2$.

15. The photographic element of claim 1 wherein said emulsion layer comprising the yellow dye forming coupler comprises silver halide grains having an aspect ratio of greater than 2 and comprising greater than 95% silver chloride.

16. A method of forming a photographic image comprising, providing a photographic element, said photographic element comprises an emulsion layer comprising a cyan dye forming coupler, an emulsion layer comprising a magenta dye forming coupler, an emulsion layer comprising a yellow dye forming coupler wherein said magenta coupler is selected from the group of P-1 and P-2

P-1

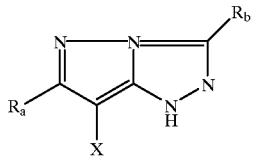

P-2

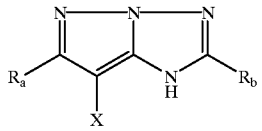

wherein $R_a$ and $R_b$ independently represent H or a substituent; X is hydrogen or a coupling-off group; and $Z_a$, $Z_b$, and $Z_c$ are independently a substituted methine group, =N—, =C—, or —NH—, provided that one of either the $Z_a$—$Z_b$ bond or the $Z_b$—$Z_c$ bond is a double bond and the other is a single bond, and when the $Z_b$—$Z_c$ bond is a carbon-carbon double bond, it may form part of an aromatic ring, and at least one of $Z_a$, $Z_b$, and $Z_c$ represents a methine group connected to the group $R_b$, and wherein between said yellow dye forming layer and said magenta dye forming layer, there is located at least one enhancer layer substantially free of silver halide comprising gelatin and said yellow dye forming coupler, said yellow coupler in said color enhancer layer comprises less than 50% of the total yellow coupler in said element and wherein said element further comprises a gelatin containing anticolor-mixing layer free of yellow coupler and silver halide, between said magenta dye forming coupler containing layer and said color enhancer layer containing dye forming coupler, exposing said element in an exposure time of less than 1 millisecond, and developing said element to obtain a photographic image.

17. The method of claim 16 forming a photographic image wherein said exposing said element is by a scanning digital exposure device.

18. A method of claim 17 wherein said exposure time is between $1\times10^{-5}$ and $1\times10^{-7}$ seconds.

19. The method of claim 17 wherein said exposure is by laser, light emitting diode, cathode ray tube, liquid crystal display, digital mirror, or light valve.

20. The method of claim 17 wherein said yellow coupler in said color enhancer layer comprises greater than 15% of the total yellow coupler in said element.

21. The method of claim 16 wherein said yellow coupler in said color enhancer layer comprises between 30 and 40% of the total yellow coupler in said element.

22. The method of claim 20 wherein said magenta coupler comprises

M-2

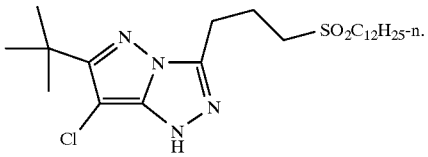

23. The method of claim 22 wherein the molar ratio of silver to total yellow coupler in said element is between 3.0 and 6.0.

24. The method of claim 23 wherein said emulsion layer containing yellow dye forming coupler comprises between 0.3 to 0.5 g/$m^2$ of silver.

25. The method of claim 16 wherein said anticolor-mixing layer comprises an oxidized developer scavenger.

26. The method of claim 25 wherein said developer scavenger comprises at least one material selected from the group consisting of hydroquinones, hydrazides, and sulfonamidophenols.

27. The method of claim 25 wherein said developer scavenger comprises 2,5-di-tert-octyl hydroquinone.

28. The method of claim 25 wherein the ratio of gelatin to other organic materials in said anticolor-mixing layer is between about 1.5 and 6.0.

29. The method of claim 16 wherein said yellow dye forming coupler comprises

Y-5

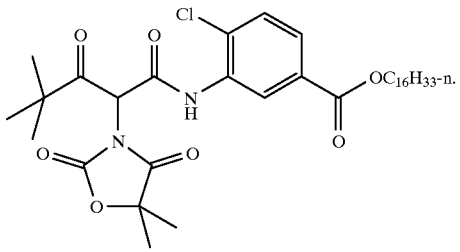

30. The photographic element of claim 1 wherein said yellow dye forming coupler comprises

Y-5

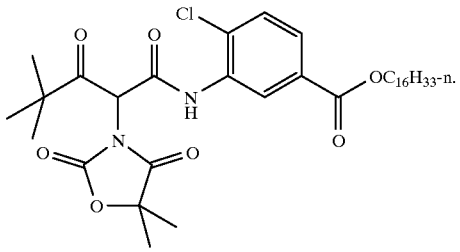

* * * * *